US010067438B2

(12) United States Patent
Murasawa et al.

(10) Patent No.: US 10,067,438 B2
(45) Date of Patent: Sep. 4, 2018

(54) ELECTROSTATIC LATENT IMAGE DEVELOPING WHITE DEVELOPER, IMAGE FORMING METHOD, IMAGE FORMING APPARATUS, AND PROCESS CARTRIDGE

(71) Applicants: Yoshihiro Murasawa, Shizuoka (JP); Hiroshi Tohmatsu, Shizuoka (JP); Hitoshi Iwatsuki, Shizuoka (JP); Mariko Takii, Kanagawa (JP); Koichi Sakata, Shizuoka (JP); Hiroyuki Kishida, Shizuoka (JP); Toyoaki Tano, Shizuoka (JP); Kenichi Mashiko, Shizuoka (JP)

(72) Inventors: Yoshihiro Murasawa, Shizuoka (JP); Hiroshi Tohmatsu, Shizuoka (JP); Hitoshi Iwatsuki, Shizuoka (JP); Mariko Takii, Kanagawa (JP); Koichi Sakata, Shizuoka (JP); Hiroyuki Kishida, Shizuoka (JP); Toyoaki Tano, Shizuoka (JP); Kenichi Mashiko, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/522,306

(22) PCT Filed: Sep. 29, 2015

(86) PCT No.: PCT/JP2015/004920

§ 371 (c)(1),
(2) Date: Apr. 27, 2017

(87) PCT Pub. No.: WO2016/067521

PCT Pub. Date: May 6, 2016

(65) Prior Publication Data

US 2017/0329247 A1 Nov. 16, 2017

(30) Foreign Application Priority Data

Oct. 30, 2014 (JP) ..... 2014-221376

(51) Int. Cl.
*G03G 9/107* (2006.01)
*G03G 9/113* (2006.01)
(Continued)

(52) U.S. Cl.
CPC ..... *G03G 9/1075* (2013.01); *G03G 9/08755* (2013.01); *G03G 9/0902* (2013.01); *G03G 9/1131* (2013.01); *G03G 9/1139* (2013.01)

(58) Field of Classification Search
CPC ... G03G 9/1075; G03G 9/1139; G03G 9/0902
See application file for complete search history.

(56) References Cited

U.S. PATENT DOCUMENTS 4,855,204 A 8/1989 Fujii et al.
4,943,506 A * 7/1990 Demizu ..... G03G 9/0902 430/108.3
(Continued)

FOREIGN PATENT DOCUMENTS

EP 2 290 454 A1 3/2011
JP 64-000574 1/1989
(Continued)

OTHER PUBLICATIONS

Borsenberger, P.M., Weiss, D. Organic Photoreceptors for Imaging Systems. Marcel-Dekker, Inc.: New York, 1993; pp. 6-17.*
(Continued)

*Primary Examiner* — Christopher D Rodee
(74) *Attorney, Agent, or Firm* — Oblon, McClelland, Maier & Neustadt, L.L.P.

(57) ABSTRACT

Provided is an electrostatic latent image developing white toner, including: a white toner including at least a binder
(Continued)

resin, a white pigment, and a release agent; and a magnetic carrier including at least a core material, and a coating layer coating the core material and made of a coating resin and conductive particles, wherein Ra of the magnetic carrier is in a range of from 0.50 μm to 1.00 μm, and a bulk density of the magnetic carrier is in a range of from 2.08 g/cm$^3$ to 2.24 g/cm$^3$.

8 Claims, 2 Drawing Sheets

(51) Int. Cl.
*G03G 9/09* (2006.01)
*G03G 9/087* (2006.01)

(56) References Cited

U.S. PATENT DOCUMENTS 6,114,077 A 9/2000 Voets et al.
7,172,844 B2 2/2007 Umemura et al.
7,261,989 B2 8/2007 Sugiura et al.
7,318,989 B2 1/2008 Kotsugai et al.
7,374,851 B2 5/2008 Nakayama et al.
7,455,942 B2 11/2008 Nagatomo et al.
8,084,176 B2 12/2011 Iwamoto et al.
8,293,446 B2 * 10/2012 Wada ..... G03G 9/107 399/222
8,877,419 B2 * 11/2014 Inoue ..... G03G 15/0126 399/162
2005/0026064 A1 2/2005 Sugiura et al.
2005/0089786 A1 4/2005 Sugiura et al.
2005/0089787 A1 4/2005 Uchinokura et al.
2005/0208408 A1 9/2005 Uchinokura et al.
2006/0029433 A1 2/2006 Saito et al.
2007/0020552 A1 * 1/2007 Matsumoto ..... G03G 9/0827 430/111.35
2007/0190444 A1 8/2007 Kotsugai et al.
2008/0014527 A1 1/2008 Kotsugai et al.
2008/0213682 A1 9/2008 Saitoh et al.
2008/0268366 A1 10/2008 Nakayama et al.
2009/0214966 A1 8/2009 Kishida
2011/0052882 A1 3/2011 Gong et al.
2011/0170915 A1 7/2011 Aoki et al.
2011/0183247 A1 7/2011 Kadokura et al.
2012/0129087 A1 * 5/2012 Iwami ..... G03G 9/107 430/106.2
2013/0040236 A1 * 2/2013 Fukushima ..... G03G 15/09 430/125.3
2013/0065171 A1 3/2013 Yaguchi et al.
2013/0078001 A1 3/2013 Koido
2013/0244162 A1 9/2013 Yamada et al.
2013/0260299 A1 10/2013 Nakajima et al.
2013/0260302 A1 10/2013 Nakajima et al.
2013/0330522 A1 12/2013 Suzuki et al.
2014/0023966 A1 * 1/2014 Sawada ..... G03G 9/1136 430/111.1
2014/0072349 A1 * 3/2014 Sakashita ..... G03G 9/09716 399/267
2015/0253685 A1 9/2015 Suzuki et al.

FOREIGN PATENT DOCUMENTS

JP 01-105962 4/1989
JP 04-070882 3/1992
JP 2000-056514 2/2000
JP 2006-220694 8/2006
JP 2007-033719 2/2007
JP 2010-008816 1/2010
JP 2011-154183 8/2011
JP 2013-057817 3/2013
JP 2013-068811 4/2013
JP 2014-016598 1/2014
JP 2014-174188 A 9/2014
JP 2014-174289 9/2014
JP 2015-169892 9/2015
RU 2386158 C1 4/2010

OTHER PUBLICATIONS

Extended European Search Report dated Sep. 15, 2017 in Patent Application No. 15854104.5.
International Search Report and Written Opinion dated Dec. 8, 2015 for counterpart International Patent Application No. PCT/JP2015/004920 filed Sep. 29, 2015.
Russian Official Decision on Grant dated Apr. 25, 2018 with English Translation.

* cited by examiner

[Fig. 1]
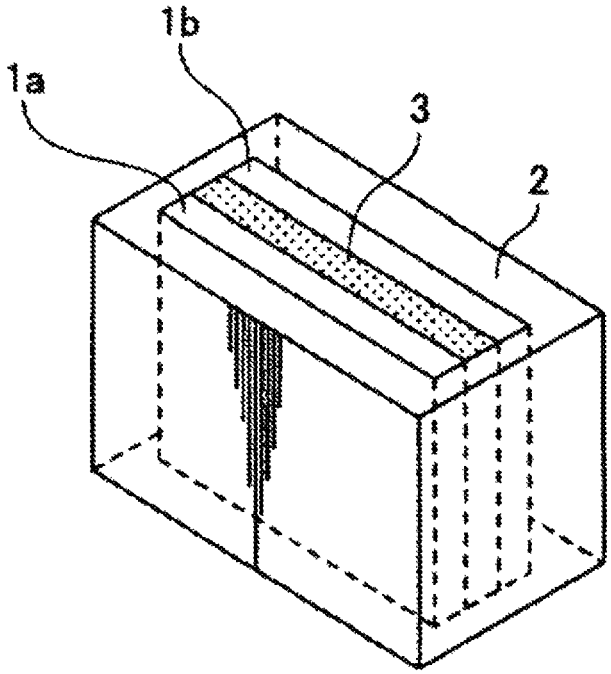
[Fig. 2]
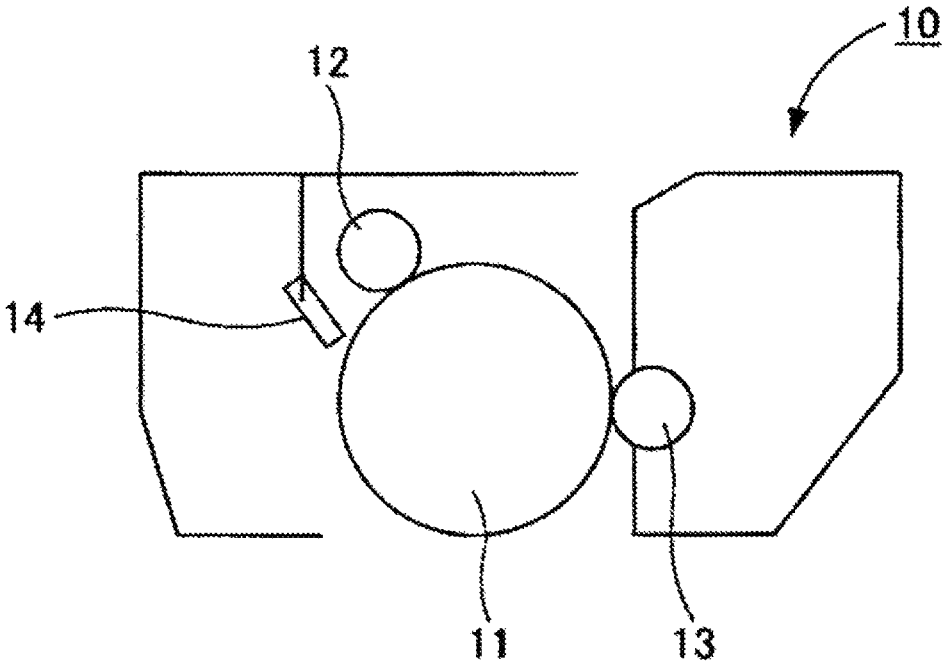

[Fig. 3]
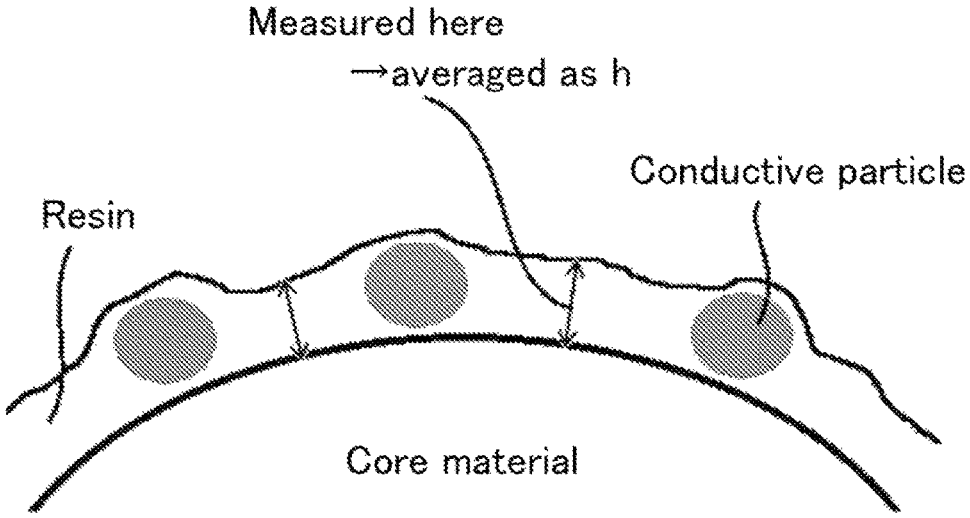

ELECTROSTATIC LATENT IMAGE DEVELOPING WHITE DEVELOPER, IMAGE FORMING METHOD, IMAGE FORMING APPARATUS, AND PROCESS CARTRIDGE

TECHNICAL FIELD

The present invention relates to an electrophotography method, an electrostatic latent image developing white developer used in an electrostatic recording method, an image forming method, an image forming apparatus, and a process cartridge.

BACKGROUND ART

In image formation by electrophotography, an electrostatic latent image is formed over an electrostatic latent image bearer such as a photoconductive material, a charged toner is attached to the electrostatic latent image to form a toner image, and the toner image is transferred to and fixed over a recording medium as an output image. In recent years, there has been an acceleration in the changeover from monochrome to full-color in the electrophotographic copier or printer technologies, and the full-color market is in the expanding tendency.

In full-color image formation, all colors are reproduced by overlaying three color toners, namely yellow, magenta, and cyan toners, or four color toners additionally including a black toner. Hence, in order to obtain a clear full-color image excellent in color reproducibility, it is necessary to smooth the surface of a fixed toner image and reduce light scattering. For this reason, many conventional full-color copiers and the like have an image gloss level of from 10% to 50%, which is a middle to high gloss level.

Recently, there have been requests for prints to be made over colored or black sheets of paper, which are colored base materials, or over transparent films, which are transparent base materials. However, a favorable color development cannot be obtained with the conventional four color toners. Hence, it is proposed to newly use a white toner as the fifth color toner and form a white background image (see PTL 1).

A white toner is used as a white base over sheets of paper, which are black or colored base materials, or as a white base over films, which are transparent base materials. In this case, the white toner is required to have a hiding property. The hiding property is an ability to make it impossible to see through the white base at which the white toner is fixed. In order for a white color to be developed as a solid white color with only a fixed white toner, it is necessary for the fixed white toner to scatter and reflect all incident rays of light. If it allows transmission of only a slight bit of incident light, its hiding property lowers, leading to perception of blur. Various proposals have been made so far to improve the hiding property (see e.g., PTL 2 and PTL 3).

However, there is a problem unique to the white toner, i.e., degradation of flowability of the toner caused by increasing the pigment concentration with a view to improving the hiding property. When the toner has a poor flowability, aggregates of several toner particles are generated in a toner bottle or in a developing device. These aggregates get stuck at a member called doctor blade configured to regulate a developer over a developer bearer in the developing device, leaving this region alone keeping the developer from being uplifted therefrom, to thereby produce an abnormal image including a white streak, which is a void in an image running in the longer direction of the image.

To this problem, a solution by means of the toner is a matter of course, but a measure by any other means than the toner is also necessary because the fundamental cause is the high pigment concentration in the white toner.

CITATION LIST

Patent Literature

PTL 1: Japanese Patent Application Laid-Open (JP-A) No. 2006-220694
PTL 2: JP-A No. 01-105962
PTL 3: JP-A No. 2000-056514

SUMMARY OF INVENTION

Technical Problem

An object of the present invention is to provide an electrostatic latent image developing white developer that provides a high image density, and does not produce an abnormal image such as a white streak due to aggregates, or cause carrier adhesion, either.

Solution to Problem

As the result of earnest studies, the present inventors have found that the problem described above can be overcome by an electrostatic latent image developing white developer described below, and reached the present invention.

That is, the present invention is as follows.

An electrostatic latent image developing white developer, including:

a white toner including at least a binder resin, a white pigment, and a release agent; and a magnetic carrier including at least a core material, and a coating layer coating the core material and made of a coating resin and conductive particles, wherein Ra of the magnetic carrier is in a range of from 0.50 μm to 1.00 μm, and a bulk density of the magnetic carrier is in a range of from 2.08 g/cm$^3$ to 2.24 g/cm$^3$.

Advantageous Effects of Invention

As will be understood from the detailed and specific description given below, the present invention can provide an electrostatic latent image developing white developer that provides a high image density, and does not produce an abnormal image such as a white streak due to aggregates, or cause carrier adhesion, either.

BRIEF DESCRIPTION OF DRAWINGS

FIG. 1 is a diagram illustrating a cell for measuring a volume resistivity in the present invention.

FIG. 2 is a diagram illustrating an example of a process cartridge of the present invention.

FIG. 3 is a diagram illustrating positions on a magnetic carrier at which thickness of a coating layer of the magnetic carrier is measured.

DESCRIPTION OF EMBODIMENTS

A white developer of the present invention will be described in detail. The white developer of the present invention is a white developer in which Ra of a carrier is in a range of from 0.50 μm to 1.00 μm, and a bulk density (AD) of the carrier is in a range of from 2.08 g/cm$^3$ to 2.24 g/cm$^3$.

According to the present invention, a white developer that does not produce abnormal images due to toner aggregates can be provided by optimizing Ra and bulk density of the carrier with respect to a white toner that is rich in a pigment. An adequate roughness of the surface of the carrier and an adequate bulk density of the carrier are considered effective for loosening toner aggregates.

Further, in the white developer of the present invention, it is preferred that a value D/h be in a range of 0.50≤D/h≤1.10, where the value D/h is a ratio of a volume average particle diameter D (μm) of conductive particles in a coating layer of a magnetic carrier to an average thickness h (μm) of the coating layer. It has turned out that when the value D/h is in the range described above, there is a greater effect of loosening toner aggregates, and the coating layer of the carrier has a greater wear resistance. A detailed cause has not been figured out, but it is inferred that wearing of the coating layer of the carrier can be suppressed by the asperity on the surface of the carrier that is adequate with respect to the white toner having a high white pigment content and a high hardness.

As described above, the white developer of the present invention will be a very great white developer that can provide images with a greater quality, provided that D/h and the white pigment content as well as Ra and bulk density of the carrier are in preferred ranges.

In the present invention, an arithmetic average surface roughness Ra of the carrier is from 0.50 μm to 1.00 μm, and preferably from 0.60 μm to 0.90 μm. When Ra is less than 0.50 μm, tonner aggregates cannot be loosened sufficiently and will produce a white streak. When Ra is greater than 1.00 μm, the carrier will be scraped off like a film due to its surface roughness, leading to frequent carrier adhesion, which is not what the present invention aims for.

The arithmetic average surface roughness Ra of the carrier can be measured with an optical microscope (e.g., OPTELICS C130 manufactured by LASERTEC Co., Ltd.) according to, for example, JIS-B0601. Specifically, an image with a resolution of 0.20 μm is captured at an objective lens magnification of ×50, an observation area is set as a 10 μm×10 μm area that spreads from a vertex portion of a particle of the carrier, and an average of surface roughness Ra values of a hundred carrier particles is measured.

The surface roughness Ra of the carrier can be brought within the intended range of the present invention, by adjusting the kind and film thickness of a coating resin, conductive particles, etc.

It is necessary that the bulk density of the carrier be from 2.08 g/cm$^3$ to 2.24 g/cm$^3$, more preferably from 2.12 g/cm$^3$ to 2.20 g/cm$^3$. When the bulk density is less than 2.08 g/cm$^3$, the mass of the carrier per particle is light, leading to the problem of carrier adhesion. When the bulk density is greater than 2.24 g/cm$^3$, there is a greater collision hazard between the carrier particles, and the carrier will be scraped off, leading to the problem of carrier adhesion.

The bulk density can be measured according to a method described in, for example, JIS-Z2504.

The bulk density of the carrier can be brought within the intended range of the present invention, by adjusting the kind and film thickness of a coating resin, conductive particles, etc.

The ratio D/h of the volume average particle diameter D (μm) of conductive particles included in the coating layer of the carrier to the average thickness h (μm) of the coating layer is preferably in the range of 0.50≤D/h≤1.10, and more preferably in the range of from 0.70≤D/h≤0.90. When D/h is less than 0.50, the conductive particles may be buried in the binder resin. When the conductive particles are buried in the binder resin, there is less protruding asperity on the surface of the carrier, making it impossible to loosen toner aggregates, leading to a white streak. On the other hand, when D/h is greater than 1.1, there is a great asperity on the surface that may wear the coating layer of the carrier, which may cause a solid carrier adhesion due to resistance drop over time.

The volume average particle diameter D of the conductive particles is preferably from 0.20 μm to 0.50 μm, and more preferably from 0.30 μm to 0.40 μm. When D is less than 0.20 μm, the conductive particles may be buried in the binder resin. When the conductive particles are buried in the binder resin, there are less particles to protrude on the surface of the carrier, making it impossible to collapse loose aggregates of the white toner. As a result, a white streak image may be produced. Loose aggregates refer to a loose state of aggregation that would be loosened when collapsed with fingers. On the other hand, when D is greater than 0.50 μm, the conductive particles form a great asperity on the surface that may wear the coating layer of the carrier. When the coating layer of the carrier is worn, a solid carrier adhesion may be produced due to resistance drop over time. When D is too large, the conductive particles themselves may hook on to each other and separate from the coating layer, which may make the film fragile. The volume average particle diameter (D) of the conductive particles can be measured with, for example, NANOTRACK UPA-EX150 (manufactured by Nikkiso Co., Ltd.).

The average thickness h of the coating layer of the carrier is preferably from 0.05 μm to 4.00 μm, and more preferably from 0.08 μm to 3.00 μm. When the average thickness h is less than 0.05 μm, the coating layer may be easily broken and scraped. When the average thickness h is greater than 4.00 μm, the coating layer that is not made of a magnetic material may adhere to an image as carrier adhesion.

The average thickness h of the coating layer of the carrier can be obtained by, for example, observing a cross-section of the carrier with a transmission electron microscope (TEM), measuring thickness values of resin moieties of the coating layer coating the surface of the carrier, and calculating an average of the measured thickness values. Specifically, thickness values of resin moieties at which conductive particles are absent are measured, as illustrated in FIG. 3. Thickness values of resin moieties that are above the conductive particles are not measured. An average of the thickness values measured at arbitrary fifty positions on the cross-section of the carrier may be calculated as the thickness h (μm).

A volume average particle diameter of the carrier particles is preferably from 32 μm to 40 μm. When the volume average particle diameter of the carrier particles is less than 32 μm, carrier adhesion may occur. When it is greater than 40 μm, reproducibility of an image may be poor at fine portions, and a precise image may not be formed.

The volume average particle diameter can be measured with, for example, a microtrac granularity distribution meter model HRA9320-X100 (manufactured by Nikkiso Co., Ltd.).

A volume resistivity of the carrier of the present invention is preferably from 8 (Log Ω·cm) to 14 (Log Ω·cm). When the volume resistivity is less than 8 (Log Ω·cm), carrier adhesion may occur at a non-image portion. When it is greater than 14 (Log Ω·cm), an intolerable level of edge effect may occur.

The volume resistivity can be measured with a cell illustrated in FIG. 1. Specifically, the carrier (3) is packed in the cell formed of a fluorine resin-made container (2) in which an electrode (1*a*) and an electrode (1*b*), both having a surface area of 2.5 cm×4 cm, are stored at a spacing of 0.2 cm. The cell is tapped ten times from a dropping height of 1 cm at a tapping speed of 30 taps/min. Next, a direct-current voltage of 1,000 V is applied across the electrode (1*a*) and the electrode (1*b*), and thirty seconds later, the resistance value r [Ω] of the carrier is measured with a high resistance meter 4329A (manufactured by Yokogawa Hewlett Packard, Ltd.). The volume resistivity R [Ω·cm] can be obtained according to a formula 2 below.

$$r\times(2.5\times4)/0.2 \qquad \text{Formula 2}$$

As the coating resin of the carrier, a silicone resin, an acrylic resin, or both in combination may be used. An acrylic resin is excellent in wear resistance with its strong adhesiveness and low brittleness, but on the other hand, has a high surface energy, and hence when used together with a toner by which the acrylic resin is likely to be spent, may cause troubles such as reduction in an amount of static buildup by having a toner component spent accumulated thereon. This problem can be overcome by a combined use of a silicone resin that is hardly spent by the toner component because of its low surface energy, and is effective for making it harder for spent component accumulation, which is the cause of scrape-off, to progress. However, a silicone resin also has its weakness of a poor wear resistance because of its weak adhesiveness and high brittleness. Hence, it is important to balance the properties of these two kinds of resins well, which makes it possible to obtain a coating film that is hardly spent and has a wear resistance at the same time.

The term "silicone resin" used herein encompasses all generally known silicone resins including but not limited to straight silicone made only of an organosiloxane bond, and silicone resins modified with alkyd, polyester, epoxy, acrylic, urethane, etc. Examples of commercially available products of straight silicone resins include KR271, KR255, and KR152 manufactured by Shin-Etsu Chemical Co., Ltd., and SR2400, SR2406, and SR2410 manufactured by Dow Corning Toray Silicone Co., Ltd. In this case, the silicone resin may be used alone, but may also be used together with another component that is cross-linking reactive, a static buildup adjusting component, etc. Examples of commercially available products of modified silicone resins include KR206 (alkyd-modified), KR5208 (acrylic-modified), ES1001N (epoxy-modified), and KR305 (urethane-modified) manufactured by Shin-Etsu Chemical Co., Ltd., and SR2115 (epoxy-modified) and SR2110 (alkyd-modified) manufactured by Dow Corning Toray Silicone Co., Ltd.

An acrylic copolymer formed of a moiety A, a moiety B, and moiety C as presented below may be used as the coating resin. A coating layer made of such an acrylic copolymer is very tough and hard to scrape, enables a high durability, and even when formed thin, hardly gets the core material exposed along with use.

[Chem. 1]

General Formula (1)

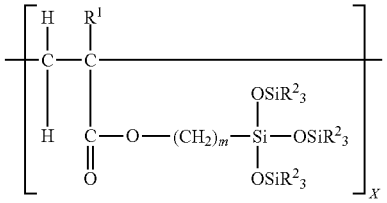

Moiety A (derived from Monomer A component)

[Chem. 2]

General Formula (2)

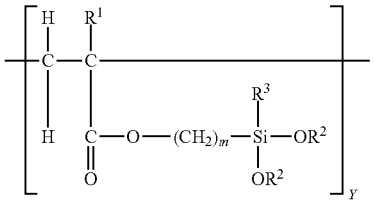

Moiety B (derived from Monomer B component)

[Chem. 3]

General Formula (3)

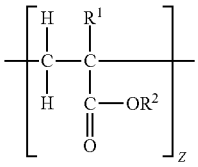

Moiety C (derived from Monomer C component)

Note that $R^1$, $R^2$, and $R^3$ in the general formula (1), the general formula (2), and the general formula (3) represent common hydrocarbon groups.

Examples of a catalyst for polymerization by condensation reaction between the resins during resin coating include titanium-based catalysts, tin-based catalysts, zirconium-based catalysts, and aluminium-based catalysts. Among these catalysts, titanium-based catalysts that bring about an excellent result are preferable in the present invention, and among titanium-based catalysts, titanium diisopropoxy bis (ethyl acetoacetate) is the most preferable as the catalyst. This is considered to be because titanium diisopropoxy bis(ethyl acetoacetate) is highly effective in promoting condensation reaction of a silanol group, and is not easily deactivated as a catalyst.

The term "acrylic resin" used herein encompasses all resins that have an acrylic component, and is not particularly limited. The acrylic resin may be used alone, but may also be used together with at least one other component that is cross-linking reactive. Examples of the at least one other component that is cross-linking reactive referred to herein include but are not limited to an amino resin, and an acidic catalyst. Examples of the amino resin referred to herein include but are not limited to guanamine and a melamine resin. Usable examples of the acidic catalyst referred to herein include all that have a catalytic action. Specific examples of the acidic catalyst include but are not limited to those that have a reactive group, such as a completely alkylated type, a methylol group type, an imino group type, and a methylol/imino group type.

It is more preferable that the coating layer include a cross-linked product of an acrylic resin with an amino resin. This allows the coating layer to be suppressed from being fused inside the coating layer itself, while maintaining an adequate elasticity.

The amino resin is not particularly limited, but is preferably a melamine resin and a benzoguanamine resin, because they can improve the charging ability of the carrier. When it is necessary to control the charging ability of the carrier appropriately, a melamine resin, a benzoguanamine resin, or both may be used in combination with another amino resin.

An acrylic resin that is cross-linkable with an amino resin is preferably one that has a hydroxyl group, a carboxyl group, or both, and more preferably one that has a hydroxyl group. This can further improve close adhesiveness of the coating layer with the core material particles and the conductive particles, and can also improve dispersion stability of the conductive particles. A hydroxyl value of the acrylic resin is preferably 10 mgKOH/g or greater, and more preferably 20 mgKOH/g or greater.

Examples of the conductive particles include metallic particles, titanium oxide, tin oxide, zinc oxide, alumina, indium tin oxide (ITO), phosphorus-doped tin, tungsten-doped tin, and carbon black, or alumina particles and titanium oxide particles that are obtained by surface-treating those above with surface-treated antimony-doped indium oxide. One of these may be used alone, or two or more of these may be used in combination.

The reason for which the conductive particles are dispersed in the coating layer of the carrier is an effect of protecting the coating layer from an external force applied to the surface of the carrier. If the particles are broken or worn easily by the external force, it is only for an initial period that their effect of protecting the coating layer is obtained, and this effect cannot be maintained for a long term, making it impossible to obtain a stable quality unfavorably. The examples of the conductive particles given above have toughness, and hence have resistance to the external force and can maintain the effect of protecting the coating layer for a long term without being broken or worn.

A location in the coating layer at which it is preferable for the conductive particles to present is in the acrylic resin. The reason for this is strong adhesiveness of the acrylic resin that enables the acrylic resin to retain the conductive particles for a long term. However, it is not indispensable that the conductive particles be present in the acrylic resin.

The content of the conductive particles is preferably from 0.1 parts by mass to 1,000 parts by mass, and more preferably from 70 parts by mass to 700 parts by mass relative to 100 parts by mass of the coating resin.

In the present invention, it is preferable that a coating layer composition used for forming the coating layer include a silane coupling agent.

This enables the conductive particles to be dispersed stably.

Examples of the silane coupling agent include but are not limited to γ-(2-aminoethyl)aminopropyl trimethoxy silane, γ-(2-aminoethyl)aminopropyl methyl dimethoxy silane, γ-methacryloxy propyl trimethoxy silane, N-β-(N-vinyl benzyl aminoethyl)-γ-aminopropyl trimethoxy silane hydrochloride, γ-glycidoxy propyl trimethoxy silane, γ-mercapto propyl trimethoxy silane, methyl trimethoxy silane, methyl triethoxy silane, vinyl triacetoxy silane, γ-chloropropyl trimethoxy silane, hexamethyl disilazane, γ-anilino propyl trimethoxy silane, vinyl trimethoxy silane, octadecyl dimethyl[3-(trimethoxy silyl)propyl]ammonium chloride, γ-chloropropyl methyl dimethoxy silane, methyl trichlorosilane, dimethyl dichlorosilane, trimethyl chlorosilane, allyl triethoxy silane, 3-aminopropyl methyl diethoxy silane, 3-aminopropyl trimethoxy silane, dimethyl diethoxy silane, 1,3-divinyl tetramethyl disilazane, and methacryloxy ethyl dimethyl(3-trimethoxy silyl propyl)ammonium chloride. Two or more of these may be used in combination.

Examples of commercially-available products of the silane coupling agent include AY43-059, SR6020, SZ6023, SH6020, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (all manufactured by Toray Silicone Co., Ltd.).

An additive amount of the silane coupling agent is preferably from 0.1% by mass to 10% by mass relative to the silicone resin. When the additive amount of the silane coupling agent is less than 0.1% by mass, adhesiveness of the silicone resin with the core material particles and the conductive particles is poor, and the coating layer may drop off during a long term of use. When it is greater than 10% by mass, toner film may occur during a long term of use.

In the present invention, the core material particles are not particularly limited to any material as long as it is a magnetic material. Examples thereof include: ferromagnetic metals such as iron and cobalt; iron oxide such as magnetite, hematite, and ferrite; various alloys and compounds; and resin particles obtained by dispersing these magnetic materials in a resin. Among these, Mn-based ferrite, Mn—Mg-based ferrite, and Mn—Mg—Sr ferrite are preferable for environmental concerns.

A volume average particle diameter of the core material particles is preferably from 32 μm to 40 μm, and more preferably from 33 μm to 40 μm.

Next, toner materials used in the white toner of the present invention will be described sequentially below.

<White Pigment>

A white pigment used in the present invention is preferably a titanium dioxide pigment that is surface-treated with polyol, and more preferably a titanium dioxide pigment that is coated with at least aluminium and any or both of trimethylol propane and trimethylol ethane.

Examples of commercially available products of the titanium dioxide pigments include TIPAQUE PF-739, CR-50-2, and TIPAQUE CR-60-2 (all manufactured by Ishihara Sangyo Kaisha, Ltd.). Among these, TIPAQUE PF-739 is preferable for use in a toner, because it is suppressed in moisture uptake by being treated with zirconia.

By the titanium dioxide as the white pigment being surface-treated with polyol, the white pigment can form a state of being dispersed in the binder resin while being coated with a release agent, although this depends on the relationship with the physical properties of the binder resin and the release agent. On the other hand, when the white pigment is not surface-treated, it may not be able to form a state of being coated with a release agent.

A volume average particle diameter of the white pigment is preferably from 200 nm to 300 nm.

It is preferable to add the white pigment in the toner in an amount of 50 parts by mass or greater relative to 100 parts by mass of the binder resin, in order to obtain a sufficient hiding power. In this case, the white pigment may have a great influence on the physical properties of the binder resin, when the volume average particle diameter thereof is less than 200 nm.

Further, the white pigment may have a poor hiding power when the volume average particle diameter thereof is greater than 300 nm.

The volume average particle diameter of the white pigment is more preferably from 220 nm to 270 nm.

As described above, it is preferable that the white pigment be included in the toner in an amount of from 50 parts by mass to 80 parts by mass relative to 100 parts by mass of the binder resin. This enables a sufficient hiding power.

When the content of the white pigment is less than 50 parts by mass, a sufficient white color density may not be obtained. On the other hand, when the content of the white pigment is greater than 80 parts by mass, aggregability of the toner is so high that the toner may not be loosened by an external pressure.

<Binder Resin>

The binder resin is not particularly limited, and a conventionally known binder resin may be used. For example, use of a polyester-based resin is preferable.

The binder resin of the present invention will be described below by taking a polyester-based resin for example.

Examples of monomers to constitute the polyester-based resin include the followings.

Examples of a divalent alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, and a diol obtained by polymerizing hydrogenated bisphenol A or bisphenol A with a cyclic ether such as ethylene oxide and propylene oxide.

A combined use of a trivalent or higher alcohol is preferable in order to crosslink a polyester resin. Examples of the trivalent or higher multivalent alcohol include sorbitol, 1,2,3,6-hexanetetrol, 1,4-sorbitan, pentaerythritol such as dipentaerythritol and tripentaerythritol, 1,2,4-butanetriol, 1,2,5-pentatriol, glycerol, 2-methyl propane triol, 2-methyl-1,2,4-butanetriol, trimethylol ethane, trimethylol propane, and 1,3,5-trihydroxybenzene.

Examples of an acid component to constitute the polyester-based polymer include: benzene dicarboxylic acids such as a phthalic acid, an isophthalic acid, and a terephthalic acid, or anhydries thereof; alkyl dicarboxylic acids such as a succinic acid, an adipic acid, a sebacic acid, and an azelaic acid, or anhydrides thereof; unsaturated dibasic acids such as a maleic acid, a citraconic acid, an itaconic acid, an alkenyl succinic acid, a fumaric acid, and a mesaconic acid; and unsaturated dibasic acid anhydrides such as a maleic anhydride, a citraconic anhydride, an itaconic anhydride, and an alkenyl succinic anhydride.

Examples of a trivalent or higher multivalent carboxylic acid component include a trimellitic acid, a pyromellitic acid, a 1,2,4-benzene tricarboxylic acid, a 1,2,5-benzene tricarboxylic acid, a 2,5,7-naphthalene tricarboxylic acid, a 1,2,4-naphthalene tricarboxylic acid, a 1,2,4-butane tricarboxylic acid, a 1,2,5-hexane tricarboxylic acid, 1,3-dicarboxy-2-methyl-2-methylene carboxy propane, tetra(methylene carboxy)methane, a 1,2,7,8-octane tetracarboxylic acid, and an empol trimer acid, or anhydrides or partially lower alkyl esters thereof.

When the binder resin is a polyester resin, it is preferable that the binder resin include at least two kinds of polyester resins. It is preferable that the binder resin include a first resin of which tetrahydrofuran (THF)-soluble content has a weight average molecular weight (Mw) of from 6,000 to 14,000 in a molecular weight distribution measured by GPC, and a second resin of which tetrahydrofuran-soluble content has a weight average molecular weight (Mw) of from 25,000 to 90,000 in a molecular weight distribution measured by GPC, in order to satisfy an offset property, a storage property, and fixability at the same time.

The weight average molecular weight of the binder resin can be calculated based on measurements obtained using HLC-8220GPC manufactured by Tosoh Corporation, and tetrahydrofuran (THF) as a solvent.

A hydroxyl value of the polyester-based resin as the binder resin is preferably from 20 mgKOH/g to 80 mgKOH/g, and more preferably from 25 mgKOH/g to 50 mgKOH/g.

An acid value of the polyester-based resin is preferably from 0.1 mgKOH/g to 50 mgKOH/g, and more preferably from 10 mgKOH/g to 30 mgKOH/g.

In the toner of the present invention, a resin that includes a monomer component reactive with both of a vinyl polymer component and a polyester-based resin component in at least any one of these vinyl polymer component and polyester-based resin component may also be used as a binder resin.

Among the monomers to constitute the polyester-based resin component, examples of monomers reactive with a vinyl polymer include unsaturated dicarboxylic acids such as a phthalic acid, a maleic acid, a citraconic acid, and an itaconic acid, or anhydrides thereof.

Examples of monomers to constitute the vinyl polymer component include monomers having a carboxyl group or a hydroxy group, and esters of an acrylic acid or a methacrylic acid.

When the polyester-based polymer, the vinyl polymer, and other binder resins are used in combination, it is preferable that a resin having an acid value of from 0.1 mgKOH/g to 50 mgKOH/g be equal to or greater than 60% by mass of the total amount of the binder resins.

In the present invention, the acid value of the binder resin component of the toner composition is obtained according to a method described below, and a basic operation of the method is based on JIS K-0070.

[1] A sample is used after additives other than the binder resin (polymer component) is removed therefrom, or acid values and contents of the other components than the binder resin and a cross-linked binder resin included in the sample are obtained beforehand, A pulverized product of the sample is weighed out precisely in an amount of from 0.5 g to 2.0 g, and the weight of the polymer component is given as W (g).

For example, when the acid value of the binder resin is to be measured from the toner, the acid values and contents of the colorant, a magnetic material, etc. are measured separately, so the acid value of the binder resin may be obtained by calculation.

[2] The sample is put in a 300 (ml) beaker, and 150 (ml) of a toluene/ethanol mixture liquid (at a volume ratio of 4/1) is added thereto to dissolve the sample.

[3] The resultant is titrated with a potentiometric titrator using a 0.1 mol/l KOH ethanol solution.

[4] The amount of the KOH solution used hereinabove is given as S (ml). Blank measurement is performed at the same time, and the amount of the KOH solution used in this measurement is given as B (ml). The acid value is calculated according to the following formula (1).

f represents the factor of KOH.

$$\text{Acid value (mgKOH/g)} = [(S-B)\times f\times 5.61]/W \qquad \text{Formula (1)}$$

A glass transition temperature (Tg) of the polyester-based resin used as the binder resin of the toner is preferably from 40° C. to 80° C., and more preferably from 40° C. to 75° C. in terms of a toner storage property.

When Tg is lower than 40° C., the toner easily deteriorates under a high-temperature atmosphere, and may easily cause an offset during fixing.

When Tg is higher than 80° C., fixability may be poor.

The toner of the present invention is preferably a toner obtained according to a producing method including a step of dispersing in an aqueous medium, an oil phase obtained by adding at least a crystalline polyester resin (or a precursor thereof) as a binder resin component in an organic solvent, and removing the organic solvent from the resulting O/W type dispersion liquid. Because of its crystallinity, the crystalline polyester exhibits such a thermally melting property that the viscosity thereof sharply drops at about an endothermic peak temperature thereof. That is, the crystalline polyester keeps a good heat resistant storage stability until immediately below the melting start temperature thereof, and sharply drops the viscosity at the melting start temperature (a sharp melt property) and is fixed. Hence, with the crystalline polyester, it is possible to design a toner that has a good heat resistant storage stability and low temperature fixability at the same time.

(Binder Resin Precursor)

As a crystalline polyester resin precursor, a binder resin precursor made of a modified polyester-based resin is preferable. Examples include a polyester prepolymer modified with isocyanate or epoxy.

This prepolymer is elongable or cross-linkable with a compound having an active hydrogen group (e.g., amines), and is effective in improving a release width (i.e., a difference between the lowest fixable temperature and a temperature at which hot offset occurs).

This polyester prepolymer can be synthesized easily according to a synthesizing method of reacting a conventionally-known isocyanating agent or epoxidating agent with the polyester resin serving as the base.

Examples of the isocyanating agent include: aliphatic polyisocyanate (e.g., tetramethylene diisocyanate, hexamethylene diisocyanate, and 2,6-diisocyanato methyl caproate); alicyclic polyisocyanate (e.g., isophorone diisocyanate, and cyclohexyl methane diisocyanate); aromatic diisocyanate (e.g., tolylene diisocyanate, diphenylmethane diisocyanate); aromatic aliphatic diisocyanate (e.g., α,α,α',α'-tetramethyl xylylene diisocyanate); and isocyanurates; products obtained by blocking the polyisocyanates with a phenol derivative, oxime, caprolactam, or the like; and combinations of two or more of those above.

Examples of the epoxidating agent include epichlorohydrin, which is a representative example.

A ratio of the isocyanating agent, expressed as an equivalent ratio [NCO]/[OH] of isocyanate group [NCO] to hydroxyl group [OH] of the polyester serving as the base, is typically from 5/1 to 1/1, preferably from 4/1 to 1.2/1, and more preferably from 2.5/1 to 1.5/1.

When [NCO]/[OH] is greater than 5, low temperature fixability will be poor.

When the molar ratio of [NCO] is less than 1, the polyester prepolymer has a low urea content, which will lead to a poor hot offset resistance.

A content of the isocyanating agent in the polyester prepolymer is typically from 0.5% by mass to 40% by mass, preferably from 1% by mass to 30% by mass, and more preferably from 2% by mass to 20% by mass.

A content less than 0.5% by mass will lead to a poor hot offset resistance, and is disadvantageous in terms of satisfying both of heat resistant storage stability and low temperature fixability at the same time.

A content greater than 40% by mass will lead to a poor low temperature fixability.

The number of isocyanate groups included per molecule of the polyester prepolymer is typically 1 or more, preferably an average of from 1.5 to 3, and more preferably an average of from 1.8 to 2.5.

When the number of isocyanate groups is less than 1 per molecule, a urea-modified polyester resin after elongation reaction will have a low molecular weight, which will lead to a poor hot offset resistance.

A weight average molecular weight of the binder resin precursor is preferably from $1\times10^4$ to $3\times10^5$.

(Compound Elongable or Cross-Linkable with Binder Resin Precursor)

Examples of the compound elongable or cross-linkable with the binder resin precursor include compounds having an active hydrogen group. A representative example of the compounds having an active hydrogen group is amines.

Examples of the amines include diamine compounds, trivalent or higher polyamine compounds, amino alcohol compounds, amino mercaptan compounds, amino acid compounds, and compounds obtained by blocking these amino groups.

Examples of the diamine compounds include: aromatic diamines (e.g., phenylenediamine, diethyl toluene diamine, and 4,4'-diaminodiphenylmethane); alicyclic diamines (e.g., 4,4'-diamino-3,3' dimethyl dicyclohexyl methane, diamine cyclohexane, and isophoronediamine); and aliphatic diamines (e.g., ethylene diamine, tetramethylene diamine, and hexamethylenediamine).

Examples of the trivalent or higher polyamine compounds include diethylenetriamine, and triethylene tetramine.

Examples of the amino alcohol compounds include ethanol amine, and hydroxy ethyl aniline.

Examples of the amino mercaptan compounds include aminoethyl mercaptan, and amino propyl mercaptan.

Examples of the amino acid compounds include an amino propionic acid and an amino caproic acid.

Examples of the compounds obtained by blocking these amino groups include ketimine compounds produced from the amines and ketones (e.g., acetone, methyl ethyl ketone, and methyl isobutyl ketone), and oxazoline compounds.

Among these amines, the diamine compounds, and mixtures of the diamine compounds with a small amount of the polyamine compounds are preferable.

<Organic Solvent>

In the present invention, the organic solvent is not particularly limited, and may be any organic solvent as long as it is an organic solvent in which the toner composition (the polyester-based resin precursor, the active hydrogen-including compound, a colorant, a non-reactive polyester resin, etc.) can be dissolved, or dispersed, or dissolved and dispersed.

A preferable organic solvent is one that has a boiling point lower than 150° C. and is volatile, because such an organic solvent can be easily removed.

Examples of the organic solvent include toluene, xylene, benzene, carbon tetrachloride, methylene chloride, 1,2-dichloroethane, 1,1,2-trichloroethane, trichloroethylene, chloroform, monochlorobenzene, methyl acetate, ethyl acetate, methyl ethyl ketone, acetone, and tetrahydrofuran. One of these may be used alone, or two or more of these may be used in combination.

An amount of the organic solvent to be used relative to 100 parts by mass of the toner composition is typically from 40 parts by mass to 300 parts by mass, preferably from 60 parts by mass to 140 parts by mass, and more preferably from 80 parts by mass to 120 parts by mass.

A pulverization method may be used to produce the white toner of the present invention. The pulverization method is a method of producing a toner by sufficiently mixing the binder resin, the white pigment, a release agent, and according to necessity, additives uniformly with a mixer such as a Henschel mixer and a super mixer, then melting and kneading them with a thermally melting kneader such as a heating roll, a kneader, and an extruder to mix the materials sufficiently, and then cooling and solidifying them, finely pulverizing them, and then classifying them. As the pulverization method, a jet mill method of supplying the toner into a high-speed air current to make the toner collide against a collision plate and pulverize the toner with the collision energy, a particle collision method of making the toner particles collide against each other in an air current, a mechanical pulverization method of pulverizing the toner by supplying the toner in a narrow gap of a rotor rotated at a high speed, etc. may be used.

A content of the binder resin is preferably from 50 parts by mass to 70 parts by mass, and more preferably from 56 parts by mass to 66 parts by mass relative to 100 parts by mass of toner base particles.

<Release Agent>

It is preferable that a release agent be included in the toner of the present invention in a state of coating the white pigment. As the release agent, an organic low-molecular material described below is preferable.

As the release agent, an organic low-molecular material having an acid value of from 1.0 mgKOH to 6.0 mgKOH is preferable.

A content of the release agent is preferably from 1 part by mass to 50 parts by mass relative to 100 parts by mass of toner base particles.

—Organic Low-Molecular-Material—

In addition to the colorant and the binder resin, an organic low-molecular material is added in the toner of the present invention to impart various functions.

Examples of the organic low-molecular material include fatty acid esters, esters of aromatic acids such as a phthalic acid, phosphoric acid esters, maleic acid esters, fumaric acid esters, itaconic acid esters, other esters, ketones of benzyl, benzoin compounds, benzoyl compounds, etc., hindered phenol compounds, benzotriazole compounds, aromatic sulfonamide compounds, aliphatic amide compounds, long-chain alcohols, long-chain dialcohols, long-chain carboxylic acids, and long-chain dicarboxylic acids.

Specific examples include dimethyl fumarate, monoethyl fumarate, monobutyl fumarate, monomethyl itaconate, monobutyl itaconate, diphenyl adipate, dibenzyl terephthalate, dibenzyl isophthalate, benzyl, benzoin isopropyl ether, 4-benzoyl biphenyl, 4-benzoyl diphenyl ether, 2-benzoyl naphthalene, dibenzoyl methane, 4-biphenyl carboxylic acid, stearyl stearic acid amide, oleyl stearic acid amide, stearin oleic acid amide, octadecanol, n-octyl alcohol, tetracosanoic acid, eicosanoic acid, stearic acid, lauric acid, nonadecanoic acid, palmitic acid, hydroxy octanoic acid, docosanoic acid, and compounds represented by general formulae (1) to (17) described in JP-A No. 2002-105414.

Other examples include natural waxes including: plant waxes (e.g., carnauba wax, cotton wax, Japan wax, and rice wax); animal waxes (e.g., beeswax and lanolin); mineral waxes (e.g., ozocerite and ceresin), and petroleum waxes (e.g., paraffin, microcrystalline, and petrolatum).

In addition to these natural waxes, other examples include: synthetic hydrocarbon waxes such as Fischer-Tropsch wax and polyethylene wax; and synthetic waxes such as esters, ketones, and ethers.

Yet other examples include: fatty acid amides such as 12-hydroxy stearic acid amide, stearic acid amide, anhydrous phthalic acid imide, and chlorinated hydrocarbon; homopolymers of polyacrylates such as poly-n-stearyl methacrylate and poly-n-lauryl methacrylate, which are low-molecular-weight crystalline polymeric resins, or copolymers thereof (e.g., a copolymer of n-stearyl acrylate-ethyl methacrylate); and crystalline polymers having a long alkyl group on a side chain thereof.

One of these may be used alone, or two or more of these may be used in combination.

The binder resin and the organic low-molecular material used in the present invention are not compatible with each other, and the organic low-molecular material functions as a release agent.

In this case, a melting temperature of the organic low-molecular material is preferably 100° C. or lower, and more preferably 90° C. or lower.

When the melting temperature is 100° C. or higher, cold offset is likely to occur during fixing.

A melt viscosity of the organic low-molecular material is preferably from 5 cps to 1,000 cps, and more preferably from 10 cps to 100 cps as a measurement at a temperature higher by 10° C. than the melting point of the organic low-molecular material.

When the melt viscosity is less than 5 cps, releasability may be poor. When it is greater than 1,000 cps, an effect of improving hot offset resistance and low temperature fixability may not be obtained.

When the binder resin and organic low-molecular material used are compatible at a temperature equal to or higher than the melting temperature of the organic low-molecular material, the organic low-molecular material functions as a plasticizer.

That is, the softening speed of the binder resin is increased by the organic low-molecular material, which imparts low temperature fixablity to the binder resin.

What is meant by the binder resin and the organic low-molecular material being compatibilized at a temperature equal to or higher than the melting temperature of the organic low-molecular material is that there is a risk that they may be compatibilized during the toner producing step to thereby spoil heat resistant storage stability of the toner, which is unfavorable.

An acid value of the organic low-molecular material used in the present invention is preferably from 1.0 mgKOH/g to 6.0 mgKOH/g.

When the acid value is less than 1.0 mgKOH/g, the organic low-molecular material may be dispersed in the toner independently without enclosing the white pigment therein.

When the acid value is greater than 6.0 mgKOH/g, the organic low-molecular material has a greater compatibility with the binder resin, and may not be able to function as a release agent.

—Other Materials—

As other materials than the white pigment, the binder resin, and the organic low-molecular material, inorganic particles for imparting flowability, developability, chargeability, cleanability, etc. to the toner may be used as external additives.

The inorganic particles as the external additives are not particularly limited, and appropriate inorganic particles may be selected from known inorganic particles according to the purpose. Examples thereof include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, and silicon nitride.

One of these may be used alone, or two or more of these may be used in combination.

A primary particle diameter of the inorganic particles is preferably from 5 nm to 2 μm, and more preferably from 5 nm to 500 nm.

A BET specific surface area of the inorganic particles is preferably from 20 $m^2/g$ to 500 $m^2/g$.

A content of the inorganic particles in the toner is preferably from 0.01% by mass to 5.0% by mass, and more preferably from 0.01% by mass to 2.0% by mass.

When using the inorganic particles as external additives for improving flowability, etc. of the toner, it is preferable to surface-treat the inorganic particles with a flow improver.

The flow improver refers to a substance that increases hydrophobicity of particles by surface-treating the particles, to thereby prevent degradation of a flow property and a charging property of the particles even under high humidity conditions. Examples thereof include silane coupling agents, silylating agents, silane coupling agents having an alkyl fluoride group, organic titanate-based coupling agents, aluminium-based coupling agents, silicone oils, and modified silicone oils.

It is particularly preferable to surface-treat the silica and the titanium oxide with such a flow improver and use them as hydrophobic silica and hydrophobic titanium oxide.

A cleanability improver, which is an additive for improving cleanability of the toner is added to the toner for removing a developer remaining over a photoconductor or a first transfer medium after transfer. Examples thereof include metal salts of fatty acids such as a stearic acid, such as zinc stearate and calcium stearate, and polymer particles produced by soap-free emulsion polymerization, such as polymethyl methacrylate particles and polystyrene particles.

Preferable polymer particles are those having a relatively narrow granularity distribution, and a volume average particle diameter of from 0.01 μm to 1 μm.

An additive used for charge control (charge controlling agent) is not particularly limited, and an appropriate additive may be selected from known additives according to the purpose. Examples thereof include nigrosine-based dyes, triphenylmethane-based dyes, chromium-including metal complex dyes, molybdenum acid chelate pigments, rhodamine-based dyes, alkoxy-based amines, quaternary ammonium salts (including fluorine-modified quaternary ammonium salts), alkyl amides, phosphorus or compounds thereof, tungsten or compounds thereof, fluorine-based active agents, metal salts of a salicylic acid, and metal salts of salicylic acid derivatives.

One of these may be used alone, or two or more of these may be used in combination.

The charge controlling agent may be a commercially available product. Examples of commercially available products include nigrosine dye BONTRON 03, quaternary ammonium salt BONTRON P-51, metal-including azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (both manufactured by Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (all manufactured by Hoechst AG); LRA-901, and boron complex LR-147 (manufactured by Japan Carlit Co., Ltd.); copper phthalocyanine; perylene; quinacridone; azo-pigments; and polymeric compounds having, as a functional group, a sulfonic acid group, a carboxyl group, and a quaternary ammonium salt.

A content of the charge controlling agent in the toner cannot be determined flatly because it varies depending on the kinds of the resins, presence or absence of additives, a dispersing method, etc. However, it is preferably from 0.1 parts by mass to 10 parts by mass, and more preferably from 0.2 parts by mass to 5 parts by mass relative to 100 parts by mass of the binder resins.

When the content is less than 0.1 parts by mass, charge controllability may not be obtained. When the content is greater than 10 parts by mass, chargeability of the toner may be excessively high to hold back the effect of the main charge controlling agent, which may increase an elestrostatic attractive force toward a developing roller to thereby degrade flowability of the developer and an image density.

A blending ratio between the carrier and the toner in the developer is preferably from 3 parts by mass to 10 parts by mass of the toner relative to 93 parts by mass of the carrier.

Particularly, a blending ratio in a developer used for replenishment (a replenishment toner) is preferably from 2 parts by mass to 50 parts by mass of the toner relative to 1 part by mass of the carrier. When the toner is less than 2 parts by mass, the amount of the carrier to be replenished is too high, and this excess supply of the carrier and the excessively high carrier concentration in a developing device tend to increase the amount of static buildup in the developer. The increase in the amount of static buildup in the developer leads to degradation of the developing ability and degradation of the image density. When the toner is greater than 50 parts by mass, the ratio of the carrier in the replenishment developer is low, and the opportunity of carrier replacement in an image forming apparatus is low, which makes it impossible to expect an effect against carrier degradation.

An image forming method of the present invention is an image forming method including an electrostatic latent image forming step of forming an electrostatic latent image over an electrostatic latent image bearer, a developing step of developing the electrostatic latent image with a two-component developer to form a visible image, a transfer step of transferring the visible image to a recording medium, and a fixing step of fixing the transferred image transferred to the recording medium thereon, and uses as the two-component developer, the electrostatic latent image developing white developer of the present invention solely or in combination with developers using other color toners.

An image forming apparatus of the present invention is an image forming apparatus including an electrostatic latent image bearer, an electrostatic latent image forming unit configured to form an electrostatic latent image over the electrostatic latent image bearer, a developing unit configured to develop the electrostatic latent image with a two-component developer to form a visible image, a transfer unit configured to transfer the visible image to a recording medium, and a fixing unit configured to fix the transferred image transferred to the recording medium thereon, and uses as the two-component developer, the electrostatic latent image developing white toner of the present invention solely or in combination with developers using other color toners.

As the developers using other color toners, common known developers may be used. A process cartridge of the present invention is a process cartridge including an electrostatic latent image bearer, and a developing unit configured to develop an electrostatic latent image formed over the electrostatic latent image bearer with a two-component developer to form a visible image, wherein the two-component developer is the electrostatic latent image developing white developer.

FIG. 2 illustrates an example of the process cartridge of the present invention. The process cartridge (10) integrally supports therein a photoconductor (11), a charging device (12) configured to electrically charge the photoconductor (11), a developing device (13) configured to develop an electrostatic latent image formed over the photoconductor (11) with the white developer of the present invention to form a toner image, and a cleaning device (14) configured to remove a toner remaining over the photoconductor (11) after the toner image formed over the photoconductor (11) is transferred to a recording medium. The process cartridge (10) is mountable on and demountable from an image forming apparatus such as a copier and a printer.

A method for forming an image with a color image forming apparatus mounted with the process cartridge (10) and using the white developer will be described below. First, the photoconductor (11) is driven to rotate at a predetermined peripheral velocity, and the circumferential surface of the photoconductor (11) is electrically charged to a predetermined positive or negative electric potential uniformly by the charging device (12). Next, exposure light is emitted to the circumferential surface of the photoconductor (11) from an exposure device such as a slit exposure-type exposure device, and an exposure device configured to perform exposure by laser beam scanning, and electrostatic latent images are formed sequentially. The electrostatic latent images formed over the circumferential surface of the photoconductor (11) are developed by the developing device (13) using the white developer of the present invention, to thereby form white toner images. Next, the white toner image formed over the circumferential surface of the photoconductor (11) are transferred sequentially to transfer sheets fed from a paper feeding section to a portion between the photoconductor (11) and the transfer device synchronously with the rotation of the photoconductor (11). The transfer sheets to which the white toner images have been transferred are separated from the circumferential surface of the photoconductor (11), have color toner images formed thereon next with a developer using a color toner, are introduced into the fixing device to have the images fixed thereon, and are output to the outside of the image forming apparatus as copied matters (copies). On the other hand, the surface of the photoconductor (11) from which the white toner images have been transferred is cleaned by the cleaning device (14) to have a residual white toner removed, destaticized by a destaticizing device, and then used for repetitive image formation. The foregoing description raises an example in which a color toner image is formed after a white toner image is formed. However, there may be a case in which a white toner image is formed after a color toner image is formed.

The image forming apparatus of the present invention includes an electrostatic latent image bearer, an electrostatic latent image forming unit configured to form an electrostatic latent image over the electrostatic latent image bearer, a developing unit configured to develop the electrostatic latent image formed over the electrostatic latent image bearer with a two-component developer to form a toner image, a transfer unit configured to transfer the toner image formed over the electrostatic latent image bearer to a recording medium, and a fixing unit configured to fix the toner image transferred to the recording medium thereon, further includes other units appropriately selected according to necessity, such as destaticizing unit, a cleaning unit, a recycling unit, a controlling unit, etc., and uses as the developer, the white developer of the present invention solely or in combination with developers using other color toners.

The present invention relates to an electrostatic latent image developing white developer according to [1] below, but also includes [2] to [6] below as embodiments.

[1] An electrostatic latent image developing white developer, including:

a white toner including at least a binder resin, a white pigment, and a release agent; and a magnetic carrier including at least a core material, and a coating layer coating the core material and made of a coating resin and conductive particles, wherein Ra of the magnetic carrier is in a range of from 0.50 μm to 1.00 μm, and a bulk density of the magnetic carrier is in a range of from 2.08 g/cm$^3$ to 2.24 g/cm$^3$.

[2] The electrostatic latent image developing white developer according to [1], wherein a ratio D/h of a volume average particle diameter D (μm) of the conductive particles in the coating layer of the magnetic carrier to an average thickness h (μm) of the coating layer is in a range of $0.50 \leq D/h \leq 1.10$.

[3] The electrostatic latent image developing white developer according to [1] or [2], wherein the white pigment is titanium oxide surface-treated with a polyol, and a content of the titanium oxide in the white toner is from 50 parts by mass to 80 parts by mass relative to 100 parts by mass of the binder resin, and wherein the binder resin includes at least two kinds of polyester resins including a first polyester resin and a second polyester resin, the first polyester resin has a weight average molecular weight of from 6,000 to 14,000, and the second polyester resin has a weight average molecular weight of from 25,000 to 90,000.

[4] An image forming method, including:

an electrostatic latent image forming step of forming an electrostatic latent image over an electrostatic latent image bearer;

a developing step of developing the electrostatic latent image with a two-component developer to form a visible image;

a transfer step of transferring the visible image to a recording medium; and a fixing step of fixing the transferred image transferred to the recording medium thereon, wherein as the two-component developer, the electrostatic latent image developing white developer according to any one of [1] to [3] is used solely or in combination with a developer using another color toner.

[5] An image forming apparatus, including:

an electrostatic latent image bearer;

an electrostatic latent image forming unit configured to form an electrostatic latent image over the electrostatic latent image bearer;

a developing unit configured to develop the electrostatic latent image with a two-component developer to form a visible image;

a transfer unit configured to transfer the visible image to a recording medium; and a fixing unit configured to fix the transferred image transferred to the recording medium thereon, wherein as the two-component developer, the electrostatic latent image developing white developer according to any one of [1] to [3] is used solely or in combination with a developer using another color toner.

[6] A process cartridge, including:

an electrostatic latent image bearer; and a developing unit configured to develop an electrostatic latent image formed over the electrostatic latent image bearer with a two-component developer to form a visible image, wherein the two-component developer is the electrostatic latent image developing white developer according to any one of [1] to [3].

EXAMPLES

The present invention will be described below more specifically by raising Examples and Comparative Examples. However, the present invention is not limited to these Examples. Note that "part" represents part by mass.

Production Examples of Core Material

Core Material Production Example 1

Particles of $MnCO_3$, $Mg(OH)_2$, $Fe_2O_3$, and $SrCO_3$ were weighed out and mixed, to obtain a mixture powder.

The mixture powder was calcined in a heating furnace at 850° C. under an air atmosphere, and the obtained calcined product was cooled and pulverized to a powder having a particle diameter of 3 μm or less. This powder was added to water together with 1% by mass of a dispersant to be formed into a slurry, and the slurry was fed to a spray dryer to be granulated, to thereby obtain a granulated product having an average particle diameter of about 40 μm.

The granulated product was loaded into a burning furnace, and burned under a nitrogen atmosphere at 1,150° C. for 4 hours. A componential analysis of the burned product was performed, and it was revealed that MnO was 40.0 mol %, MgO was 10.0 mol %, $Fe_2O_3$ was 49.6 mol %, and SrO was 0.4 mol %. The obtained burned product was pulverized with a pulverizer, and sieved for granularity adjustment, to thereby obtain spherical ferrite particles C1 having a volume average particle diameter of 35 μm and a bulk density of 2.11 g/cm$^3$.

The volume average particle diameter was measured in water with a microtrac granularity distribution meter model HRA9320-X100 (manufactured by Nikkiso Co., Ltd.) at a material refractive index of 2.42, a solvent refractive index of 1.33, and a concentration of about 0.06.

The bulk density was measured according to JIS-Z2504.

Core Material Production Example 2

Likewise, spherical ferrite particles C2 having a volume average particle diameter of 35 μm, and a bulk density of 2.01 g/cm$^3$, were obtained by performing burning at 1,120° C. for 4 hours.

Conductive Particle Production Example 1

Aluminium oxide (AKP-30 manufactured by Sumitomo Chemical Co., Ltd.) (100 g) was dispersed in water (1 liter) to produce a suspension liquid, which was heated to 65° C. A solution obtained by dissolving stannic chloride (46 g) and phosphorus pentoxide (0.5 g) in a 2N hydrochloric acid (1.7 liter), and 12% by mass ammonia water were dropped into the suspension liquid in 54 minutes such that pH of the suspension liquid would be from 7 to 8. After the dropping, the suspension liquid was filtered and washed, and a resulting cake was dried at 110° C. Next, the resulting dry powder was treated under a nitrogen stream at 500° C. for 1 hour, to thereby obtain conductive particles P1 having a volume average particle diameter of 0.18 μm. The volume average particle diameter was measured in water with NANOTRAC UPA-EX150 (manufactured by Nikkiso Co., Ltd.), at a material refractive index of 1.66, and a solvent refractive index of 1.33.

Conductive Particle Production Example 2

Conductive particles P2 having a volume average particle diameter of 0.20 μm were obtained in the same manner as for P1, except that stannic chloride (51 g) and phosphorus pentoxide (0.5 g) were dropped in 1 hour unlike in the preparation of Conductive Particle Production Example 1.

Conductive Particle Production Example 3

Conductive particles P3 having a volume average particle diameter of 0.35 μm were obtained in the same manner as for P1, except that stannic chloride (90 g) and phosphorus pentoxide (0.9 g) were dropped in 1 hour and 45 minutes unlike in the preparation of Conductive Particle Production Example 1.

Conductive Particle Production Example 4

Conductive particles P4 having a volume average particle diameter of 0.50 μm were obtained in the same manner as for P1, except that stannic chloride (128 g) and phosphorus pentoxide (1.3 g) were dropped in 2 hours and 30 minutes unlike in the preparation of Conductive Particle Production Example 1.

Conductive Particle Production Example 5

Conductive particles 5 having a volume average particle diameter of 0.52 μm were obtained in the same manner as for P1, except that stannic chloride (133 g) and phosphorus pentoxide (1.4 g) were dropped in 2 hours and 36 minutes unlike in the preparation of Conductive Particle Production Example 1.

Resin Synthesis Example

Toluene (300 g) was put in a flask equipped with a stirrer, and heated to 90° C. under a nitrogen gas stream. To which, a mixture of 3-methacryloxy propyl tris(trimethyl siloxane) silane (84.4 g) (200 millimole: SILAPLANE TM-0701T manufactured by Chisso Corporation), 3-methacryloxy propyl methyl diethoxy silane (39 g) (150 millimole), methyl methacrylate (65.0 g) (650 millimole), and 2,2'-azobis-2-methyl butyronitrile (0.58 g) (3 millimole) was dropped in 1 hour. After the dropping was completed, a solution obtained by dissolving 2,2'-azobis-2-methyl butyronitrile (0.06 g) (0.3 millimole) in toluene (15 g) was further added thereto (resulting in a total 2,2'-azobis-2-methyl butyronitrile amount of 0.64 g=3.3 millimole), and they were mixed at 90° C. to 100° C. for 3 hours to be radically copolymerized, to thereby obtain a methacrylic-based copolymer R1.

Carrier Production Example 1

(Carrier Coating Layer)

Silicone resin solution (with a solid content of 20% by mass (SR2410: manufactured by Dow Corning Toray Silicone Co., Ltd.))

1,215 parts by mass

Titanium catalyst (with a solid content of 60% by mass (TC-750: manufactured by Matsumoto Fine Chemical Co., Ltd.))

4 parts by mass

Amino silane (with a solid content of 100% by mass (SH6020: manufactured by Dow Corning Toray Silicone Co., Ltd.)

3.2 parts by mass

Conductive particles P4 110 parts by mass

Toluene 1,000 parts by mass

The materials described above were dispersed with a homomixer for 10 minutes, to thereby obtain a silicone resin mixture coating film forming solution. With a spiller coater (manufactured by Okada Seiko Co., Ltd.), the coating film forming solution was applied over the surface of a core material, which was C1 (5,000 parts by mass), and dried at an internal temperature of the coater of 55° C. The obtained carrier was left in an electric furnace at 200° C. for 1 hour to be burned.

The obtained ferrite powder bulk was cooled, and then broken apart through a sieve having a mesh of 63 μm, to thereby obtain a carrier 1 having a volume average particle diameter of 36 μm, a volume resistivity of 11 Log Ωcm, a bulk density of 2.24 g/cm$^3$, and a coating layer average thickness of 0.45 μm.

The volume average particle diameter was measured in water with a microtrac granularity distribution meter model HRA9320-X100 (manufactured by Nikkiso Co., Ltd.) at a material refractive index of 2.42, a solvent refractive index of 1.33, and a concentration of about 0.06.

The volume resistivity was measured with a cell illustrated in FIG. 1. The carrier (3) was packed in the cell formed of a fluorine resin-made container (2) in which an electrode (1*a*) and an electrode (1*b*), both having a surface area of 2.5 cm×4 cm, were stored at a spacing of 0.2 cm. The cell was tapped ten times from a dropping height of 1 cm at a tapping speed of 30 taps/min. After this, a direct-current voltage of 1,000 V was applied across the electrode (1*a*) and the electrode (1*b*), and thirty seconds later, the resistance value r [Ω] of the carrier was measured with a high resistance meter 4329A (manufactured by Yokogawa Hewlett Packard, Ltd.). The volume resistivity [Ω·cm] was calculated according to a formula 2 below.

$$r\times(2.5\times4)/0.2 \qquad \text{Formula 2}$$

An arithmetic average surface roughness Ra was measured with the above-described optical microscope (e.g., OPTELICS C130 manufactured by LASERTEC Co., Ltd.) according to JIS-B0601.

The bulk density was measured according to JIS-Z2504. The average thickness h of the coating layer of the carrier was obtained by observing a cross-section of the carrier with a transmission electron microscope (TEM), measuring thickness values of resin moieties of the coating layer coating the surface of the carrier, and calculating an average of the measured thickness values. Specifically, thickness values of resin moieties at which conductive particles were absent were measured, as illustrated in FIG. 3. Thickness values of resin moieties that were above the conductive particles were not measured. An average of the thickness values measured at arbitrary fifty positions on the cross-section of the carrier was calculated as the thickness h (μm).

Carrier Production Example 2

A carrier 2 having a volume average particle diameter of 36 μm, a volume resistivity of 11 Log Ωcm, a bulk density of 2.24 g/cm$^3$, and a coating layer average thickness of 0.25 μm was obtained in the same manner as for the carrier 1, except that the silicone resin solution was used in an amount of 1,188 parts by mass, and the conductive particles P2 were used unlike in Carrier Production Example 1.

Carrier Production Example 3

A carrier 3 having a volume average particle diameter of 36 μm, a volume resistivity of 11 Log Ωcm, a bulk density of 2.08 g/cm$^3$, and a coating layer average thickness of 0.44 μm was obtained in the same manner as for the carrier 1, except that the silicone resin solution was used in an amount of 1,188 parts by mass, the conductive particles P3 were used, and the core material particles C2 were used unlike in Carrier Production Example 1.

Carrier Production Example 4

A carrier 4 having a volume average particle diameter of 36 μm, a volume resistivity of 11 Log Ωcm, a bulk density of 2.08 g/cm$^3$, and a coating layer average thickness of 0.40 μm was obtained in the same manner as for the carrier 1, except that the silicone resin solution was used in an amount of 1,080 parts by mass, the conductive particles P2 were used, and the core material particles C2 were used unlike in Carrier Production Example 1.

Carrier Production Example 5

A carrier 5 having a volume average particle diameter of 36 μm, a volume resistivity of 11 Log Ωcm, a bulk density of 2.16 g/cm$^3$, and a coating layer average thickness of 0.46 μm was obtained in the same manner as for the carrier 1, except that the silicone resin solution was used in an amount of 1,242 parts by mass, and the conductive particles P5 were used unlike in Carrier Production Example 1.

Carrier Production Example 6

A carrier 6 having a volume average particle diameter of 36 μm, a volume resistivity of 11 Log Ωcm, a bulk density of 2.16 g/cm$^3$, and a coating layer average thickness of 0.38 μm was obtained in the same manner as for the carrier 1, except that the silicone resin solution was used in an amount of 1,026 parts by mass, and the conductive particles P1 were used unlike in Carrier Production Example 1.

Carrier Production Example 7

A carrier 7 having a volume average particle diameter of 36 μm, a volume resistivity of 11 Log Ωcm, a bulk density of 2.16 g/cm$^3$, and a coating layer average thickness of 0.44 μm was obtained in the same manner as for the carrier 1, except that the silicone resin solution was used in an amount of 1,188 parts by mass, and the conductive particles P3 were used unlike in Carrier Production Example 1.

Carrier Production Example 8

Methacrylic-based copolymer R1 (with a solid content of 20% by mass)
1,188 parts by mass
Titanium catalyst (with a solid content of 60% by mass (TC-750: manufactured by Matsumoto Fine Chemical Co., Ltd.))
4 parts by mass
Amino silane (with a solid content of 100% by mass (SH6020: manufactured by Dow Corning Toray Silicone Co., Ltd.)
3.2 parts by mass
Conductive particles P3 100 parts by mass
Toluene 1,000 parts by mass The materials described above were dispersed with a homomixer for 10 minutes, to thereby obtain a mixture coating film forming solution. With a spiller coater (manufactured by Okada Seiko Co., Ltd.), the coating film forming solution was applied over the surface of a core material, which was C1 (5,000 parts by mass), and dried at an internal temperature of the coater of 55° C. The obtained carrier was left in an electric furnace at 200° C. for 1 hour to be burned The obtained ferrite powder bulk was cooled, and then broken apart through a sieve having a mesh of 63 μm, to thereby obtain a carrier 8 having a volume average particle diameter of 36 μm, a volume resistivity of 11 Log Ωcm, a bulk density of 2.16 g/cm$^3$, and a coating layer average thickness of 0.44 μm.

Carrier Production Example 1'

A carrier 1' having a volume average particle diameter of 36 μm, a volume resistivity of 11 Log Ωcm, a bulk density of 2.05 g/cm$^3$, and a coating layer average thickness of 0.44 μm was obtained in the same manner as for the carrier 1, except that the silicone resin solution was used in an amount of 1,188 parts by mass, the conductive particles P3 were used, and the core material particles C2 were used unlike in Carrier Production Example 1.

Carrier Production Example 2'

A carrier 2' having a volume average particle diameter of 36 μm, a volume resistivity of 11 Log Ωcm, a bulk density of 2.28 g/cm$^3$, and a coating layer average thickness of 0.40 μm was obtained in the same manner as for the carrier 1, except that the silicone resin solution was used in an amount of 1,080 parts by mass, and the conductive particles P2 were used.

Carrier Production Example 3'

A carrier 3' having a volume average particle diameter of 36 μm, a volume resistivity of 11 Log Ωcm, a bulk density of 2.16 g/cm$^3$, and a coating layer average thickness of 0.70 μm was obtained in the same manner as for the carrier 1, except that the silicone resin solution was used in an amount of 1,890 parts by mass, and the conductive particles P3 were used.

Carrier Production Example 4'

A carrier 4' having a volume average particle diameter of 36 μm, a volume resistivity of 11 Log Ωcm, a bulk density of 2.16 g/cm$^3$, and a coating layer average thickness of 0.32 μm was obtained in the same manner as for the carrier 1, except that the silicone resin solution was used in an amount of 864 parts by mass, and the conductive particles P3 were used.

Production Example of Base Toner Particles 1

Polyester resin A (with a weight average molecular weight of 10,000)
40 parts
Polyester resin B (with a weight average molecular weight of 60,000)
60 parts
Carnauba wax 1 part
Titanium dioxide (TIPAQUE PF-739 manufactured by Ishihara Sangyo Kaisha, Ltd.) 48 parts The toner constituent materials described above were mixed with a Henschel mixer (HENSCHEL 20B manufactured by Mitsui Mining Company, Ltd., at 1,500 rpm for 3 minutes), and kneaded with a uniaxial kneader (COMPACT BUSS CO-KNEADER manufactured by Buss, Inc.) under the following conditions (set temperatures: 100° C. at the inlet and 50° C. at the outlet, and a feed amount of 2 kg/Hr), to thereby obtain a [base toner A1].

The [base toner A1] was further kneaded, then rolled and cooled, pulverized with a pulverizer, finely pulverized with an I type mill (IDS-2 type manufactured by Nippon Pneumatic Mfg. Co., Ltd., with a planar collision plate, at an air pressure of 6.8 atm/cm$^2$, and at a feed amount of 0.5 kg/hr), and further classified (with 132MP manufactured by Alpine Aktiengesellschaft), to thereby obtain [base toner particles 1].

Production Example of Base Toner Particles 2

Base toner particles 2 were obtained in the same manner as for the base toner particles 1, except that TIPAQUE PF-739 was used in an amount of 50 parts by mass unlike in the production example 1 of the base toner particles 1.

Production Example of Base Toner Particles 3

Base toner particles 3 were obtained in the same manner as for the base toner particles 1, except that TIPAQUE PF-739 was used in an amount of 65 parts by mass unlike in the production example 1 of the base toner particles 1.

Production Example of Base Toner Particles 4

Base toner particles 4 were obtained in the same manner as for the base toner particles 1, except that TIPAQUE PF-739 was used in an amount of 80 parts by mass unlike in the production example 1 of the base toner particles 1.

Production Example of Base Toner Particles 5

Base toner particles 5 were obtained in the same manner as for the base toner particles 1, except that TIPAQUE PF-739 was used in an amount of 82 parts by mass unlike in the production example 1 of the base toner particles 1.

(External Additive Treatment)

As an external additive, hydrophobic silica particles (R972 manufactured by Nippon Aerosil Co., Ltd.) (1.0 part by mass) were added to the "base toner particles 1 to 5" (100 parts by mass) respectively, and they were mixed with a Henschel mixer, to thereby obtain toner particles (hereinafter referred to as "toners 1 to 5", respectively).

Examples 1 to 10, and Comparative Examples 1 to 4

<Production of Developers 1 to 10 and 1' to 4'>

7.0 parts of the toners (7.2 m) obtained in the toner production examples were added to 93 parts of the carriers obtained in the carrier production examples, and they were stirred with a ball mill for 20 minutes, to thereby produce developers 1 to 10 and 1' to 4'.

Combinations in the developers, toner compositions, carrier compositions, and physical properties were presented in Tables 1-1 and 1-2.

<Quality Evaluation by Actual Equipment>

Characteristic tests on image qualities were performed with RICOH PRO C751EX manufactured by Ricoh Company, Ltd. (a digital color copier/printer multifunction peripheral manufactured by Ricoh Company, Ltd.) under the developing conditions described below.

Developing gap (between a photoconductor and a developing sleeve): 0.3 mm

Doctor gap (between the developing sleeve and a doctor): 0.65 mm

Photoconductor linear velocity: 440 mm/sec (Developing sleeve linear velocity)/(photoconductor linear velocity): 1.80

Writing density: 600 dpi

Charged potential (Vd): −600 V

Exposed potential at a region corresponding to an image portion (a solid portion of a script): −100 V Developing bias: DC −500 V/alternating-current bias component: 2 KHz, −100 V to −900 V, 50% duty (1) Image Density at a Solid Portion With a spectroscopic colorimetric densitometer X-RITE 938, image density was measured from five positions in the center of a 30 mm×30 mm solid portion (see Note 1 below) under the developing conditions described above, and an average of the measurements was calculated.

Note 1; a portion corresponding to a region under a developing potential of 400 V=(exposed potential—developing bias DC)=−100 V−(−500 V)

An ID difference between an initially output image and an image outputted after 1,000,000 images was evaluated based on the criteria described below.

Equal to or greater than 0 but less than 0.2: A (very good)

Equal to or greater than 0.2 but less than 0.3: B (good)

Equal to or greater than 0.3 but less than 0.4: C (usable)

Equal to or greater than 0.4: D (bad)

(2) White Streak Image

The solid image outputted after the 1,000,000 images was visually observed to see whether there was any image void in the same direction as the paper ejection direction. A developer that produced no image void was evaluated as passable (A), a developer that produced a slight image void was evaluated as usable (B), and a developer that produced an apparent image void was evaluated as rejectable (C).

(3) Carrier Adhesion (Solid Portion)

Carrier adhesion is a cause of damages on a photoconductor drum or a fixing roller, leading to a poor image quality. Carrier adhesion was evaluated according to the method described below, because carrier adhesion on a photoconductor would cause only part of the carrier to be transferred to a sheet.

The number of carrier particles adhered on a solid image (30 mm×30 mm) formed by RICOH PRO C901 under the developing conditions described above (a charged potential (Vd): −600 V, an exposed potential at a region corresponding to an image portion (a solid portion of a script): −100 V, and a developing bias: DC −500 V) was counted over the photoconductor, to evaluate carrier adhesion on a solid portion.

In the table below, a sign A represents "very good", a sign B represents "good", a sign C represents "usable", and a sign D represents "bad".

TABLE 1-1

| | Developer name | Toner name | Pigment (part by mass) | Carrier name | Core material | Conductive particles |
|---|---|---|---|---|---|---|
| Ex. 1 | 1 | 3 | 65 | 1 | C1 | P4 |
| Ex. 2 | 2 | 4 | 80 | 2 | C1 | P2 |
| Ex. 3 | 3 | 3 | 65 | 3 | C2 | P3 |
| Ex. 4 | 4 | 2 | 50 | 4 | C2 | P2 |
| Ex. 5 | 5 | 3 | 65 | 5 | C1 | P5 |
| Ex. 6 | 6 | 3 | 65 | 6 | C1 | P1 |
| Ex. 7 | 7 | 1 | 48 | 7 | C1 | P3 |
| Ex. 8 | 8 | 5 | 82 | 7 | C1 | P3 |
| Ex. 9 | 9 | 3 | 65 | 7 | C1 | P3 |
| Ex. 10 | 10 | 3 | 65 | 8 | C1 | P3 |
| Comp. Ex. 1 | 1' | 3 | 65 | 1' | C2 | P3 |
| Comp. Ex. 2 | 2' | 3 | 65 | 2' | C1 | P2 |
| Comp. Ex. 3 | 3' | 3 | 65 | 3' | C1 | P3 |
| Comp. Ex. 4 | 4' | 3 | 65 | 4' | C1 | P3 |

TABLE 1-2

| | Carrier AD ($g/cm^3$) | Carrier Ra (μm) | Conductive particles D (μm) | Coating layer h (μm) | D/h |
|---|---|---|---|---|---|
| Ex. 1 | 2.24 | 1.00 | 0.50 | 0.45 | 1.10 |
| Ex. 2 | 2.24 | 0.50 | 0.20 | 0.25 | 0.80 |
| Ex. 3 | 2.08 | 1.00 | 0.35 | 0.44 | 0.80 |
| Ex. 4 | 2.08 | 0.50 | 0.20 | 0.40 | 0.50 |
| Ex. 5 | 2.16 | 1.00 | 0.52 | 0.46 | 1.12 |
| Ex. 6 | 2.16 | 0.50 | 0.18 | 0.38 | 0.48 |
| Ex. 7 | 2.16 | 0.70 | 0.35 | 0.44 | 0.80 |
| Ex. 8 | 2.16 | 0.70 | 0.35 | 0.44 | 0.80 |
| Ex. 9 | 2.16 | 0.70 | 0.35 | 0.44 | 0.80 |
| Ex. 10 | 2.16 | 0.70 | 0.35 | 0.44 | 0.80 |
| Comp. Ex. 1 | 2.03 | 0.70 | 0.35 | 0.44 | 0.80 |
| Comp. Ex. 2 | 2.28 | 0.50 | 0.20 | 0.40 | 0.50 |
| Comp. Ex. 3 | 2.16 | 0.48 | 0.35 | 0.70 | 0.50 |
| Comp. Ex. 4 | 2.16 | 1.04 | 0.35 | 0.32 | 1.10 |

TABLE 2

| | Developer name | ID | White streak | Carrier adhesion |
|---|---|---|---|---|
| Ex. 1 | 1 | B | A | C |
| Ex. 2 | 2 | A | A | C |
| Ex. 3 | 3 | B | A | C |
| Ex. 4 | 4 | B | B | B |
| Ex. 5 | 5 | B | A | C |
| Ex. 6 | 6 | B | B | B |
| Ex. 7 | 7 | C | A | B |
| Ex. 8 | 8 | A | A | C |
| Ex. 9 | 9 | B | A | A |
| Ex. 10 | 10 | B | A | A |
| Comp. Ex. 1 | 1' | B | A | D |
| Comp. Ex. 2 | 2' | B | A | D |
| Comp. Ex. 3 | 3' | B | C | B |
| Comp. Ex. 4 | 4' | B | A | D |

REFERENCE SIGNS LIST

1*a* electrode
1*b* electrode
2 fluorine resin-made container
3 carrier
10 process cartridge
11 photoconductor
12 charging device
13 developing device
14 cleaning device

The invention claimed is:

1. An electrostatic latent image developing white developer, comprising:

a white toner comprising a binder resin, a white pigment, and a release agent; and a magnetic carrier comprising a core material, and a coating layer coating the core material and made of a coating resin and conductive particles, wherein Ra of the magnetic carrier ranges from 0.50 μm to 1.00 μm, and a bulk density of the magnetic carrier ranges from 2.08 g/cm$^3$ to 2.24 g/cm$^3$, the white pigment is titanium oxide surface-treated with a polyol, and a content of the titanium oxide in the white toner is from 50 parts by mass to 80 parts by mass relative to 100 parts by mass of the binder resin, and the binder resin comprises at least two polyester resins comprising a first polyester resin and a second polyester resin, the first polyester resin having a weight average molecular weight of from 6,000 to 14,000, and the second polyester resin having a weight average molecular weight of from 25,000 to 90,000.

2. The electrostatic latent image developing white developer according to claim 1, wherein a ratio D/h of a volume average particle diameter D (μm) of the conductive particles in the coating layer of the magnetic carrier to an average thickness h (μm) of the coating layer satisfies: $0.50 \leq D/h \leq 1.10$.

3. An image forming method, comprising:

forming an electrostatic latent image over an electrostatic latent image bearer;

developing the electrostatic latent image with a two-component developer to form a visible image;

transferring the visible image to a recording medium; and fixing the transferred image transferred to the recording medium thereon, wherein as the two-component developer, the electrostatic latent image developing white developer according to claim 2 is used solely or in combination with a developer using another color toner.

4. An image forming apparatus, comprising:

an electrostatic latent image bearer;

an electrostatic latent image forming unit configured to form an electrostatic latent image over the electrostatic latent image bearer;

a developing unit containing a two-component developer and configured to develop the electrostatic latent image with the two-component developer to form a visible image;

a transfer unit configured to transfer the visible image to a recording medium; and a fixing unit configured to fix the transferred image transferred to the recording medium thereon, wherein the two-component developer comprises the electrostatic latent image developing white developer according to claim 2 and optionally a developer comprising another color toner.

5. A process cartridge, comprising:

an electrostatic latent image bearer; and a developing unit containing a two-component developer and configured to develop an electrostatic latent image formed over the electrostatic latent image bearer with the two-component developer to form a visible image, wherein the two-component developer is the electrostatic latent image developing white developer according to claim 2.

6. An image forming method, comprising:

forming an electrostatic latent image over an electrostatic latent image bearer;

developing the electrostatic latent image with a two-component developer to form a visible image;

transferring the visible image to a recording medium; and fixing the transferred image transferred to the recording medium thereon, wherein as the two-component developer, the electrostatic latent image developing white developer according to claim 1 is used solely or in combination with a developer using another color toner.

7. An image forming apparatus, comprising:

an electrostatic latent image bearer;

an electrostatic latent image forming unit configured to form an electrostatic latent image over the electrostatic latent image bearer;

a developing unit containing a two-component developer and configured to develop the electrostatic latent image with the two-component developer to form a visible image;

a transfer unit configured to transfer the visible image to a recording medium; and a fixing unit configured to fix the transferred image transferred to the recording medium thereon, wherein the two-component developer comprises the electrostatic latent image developing white developer according to claim 1 and optionally a developer comprising another color toner.

8. A process cartridge, comprising; an electrostatic latent image bearer; and a developing unit containing a two-component developer and configured to develop an electrostatic latent image formed over the electrostatic latent image bearer with the two-component developer to form a visible image, wherein the two-component developer is the electrostatic latent image developing white developer according to claim 1.

* * * * *